United States Patent [19]

Kiritani et al.

[11] Patent Number: 4,722,921

[45] Date of Patent: Feb. 2, 1988

[54] HEAT-SENSITIVE RECORDING MATERIAL

[75] Inventors: Masataka Kiritani; Toshiharu Tanaka; Takayuki Hayashi; Toshimasa Usami, all of Shizuoka, Japan

[73] Assignee: Fuji Photo Film Co., Ltd., Kanagawa, Japan

[21] Appl. No.: 855,058

[22] Filed: Apr. 23, 1986

[30] Foreign Application Priority Data

Apr. 23, 1985 [JP] Japan ..... 60-87132

[51] Int. Cl.[4] ..... B41M 5/18

[52] U.S. Cl. ..... 503/207; 427/150; 427/151; 428/323; 428/327; 428/328; 428/329; 428/330; 428/331; 503/215

[58] Field of Search ..... 346/207, 215; 427/150–152; 428/323, 322–331; 503/207, 215, 226

[56] References Cited

U.S. PATENT DOCUMENTS 4,418,942 12/1983 Hosoi et al. ..... 346/207
4,422,670 12/1983 Hasegawa et al. ..... 346/207
4,529,681 7/1985 Usami et al. ..... 430/138

*Primary Examiner*—Bruce H. Hess
*Attorney, Agent, or Firm*—Sughrue, Mion, Zinn, Macpeak & Seas

[57] ABSTRACT

A heat-sensitive recording material is disclosed, comprising a support having provided thereon a heat-sensitive recording layer containing microcapsules containing a color former and an organic solvent as core materials and a color developer exterior thereto, the wall of said microcapsules being impermeable to both of the color former and the color developer at room temperature but becoming permeable to at least one of the color former and color developer upon the application of heat, wherein the heat-sensitive recording layer further contains a pigment having an average particle size greater than that of the microcapsules. The material exhibits improved handling and running properties.

12 Claims, No Drawings

HEAT-SENSITIVE RECORDING MATERIAL

FIELD OF THE INVENTION

This invention relates to a heat-sensitive recording material and, more particularly, to a heat-sensitive recording material having improved handling and running properties.

BACKGROUND OF THE INVENTION

Heat-sensitive recording papers are known which comprise a heat-sensitive layer containing microcapsules containing, as core materials, a component capable of undergoing a color formation reaction (color former) and an organic solvent, and another component capable of reacting with the color former to develop a color (color developer). The latter being exterior the microcapsules, as described, e.g., in Japanese Patent Application (OPI) No. 190886/84 (the term "OPI" as used herein refers to a "published unexamined Japanese patent application") and Japanese Patent Application No. 6493/85.

These recording materials are not of the type where a reactive substance contained in microcapsules and a reactive substance outside of the microcapsules are brought into contact upon rupture of the microcapsules by heat or pressure to thereby develop color as in conventional recording materials, rather, are of the type where a reactive substance present inside or outside of the microcapsules is allowed to permeate through the microcapsule wall by application of heat to thereby cause color formation reaction therebetween.

In more detail, the capsule wall changes from a glassy state into a rubbery state upon instantaneous heating with a thermal head, and the color forming component is diffused through the wall to contact with the another component to cause the color forming reaction.

If a thermal head contacts the microcapsule wall softened by heating, the recording material will stick to the thermal head, resulting in poor running properties. With the recent development of rapid print out with a heating element, the demand has arisen to improve the handling and running properties of heat-sensitive recording sheets.

Good handling properties means the ability to be free from abrasion fog due to scratches on handling, etc. which causes stains on the recording surface. Good running properties means the ability to be free from "head stain" due to adhesion of the recording layer to a thermal head during continuous running on a facsimile machine, a printer, etc., to be free from a reduction of image quality arising from head stain, or to be free from the generation of "stick noise" due to adhesion between the thermal head and the recording paper during running, and the like.

SUMMARY OF THE INVENTION

An object of this invention is to provide a heat-sensitive recording material having improved handling and running properties.

As a result of extensive investigations, it has now been found that the object of this invention can be accomplished by a heat-sensitive recording material comprising a support having provided thereon a heat-sensitive recording layer containing microcapsules having a color former and an organic solvent as core materials, and a color developer exterior thereto, the wall of the microcapsules being impermeable to both of the color former and the color developer at room temperature but becoming permeable to at least one of the color former and the color developer upon heating with a thermal head to provide a color image, wherein the heat-sensitive recording layer contains a pigment having an average particle size greater than that of the microcapsules, and preferably 1.3 times or more greater than that of the microcapsules. The present invention was completed based on this finding.

DETAILED DESCRIPTION OF THE INVENTION

The "average particle size" used herein is determined by the following relationships. The unit thereof is "μm" (linear parameter).

$$\frac{4}{3}\pi\left(\frac{\phi}{2}\right)^3 = \left(\frac{\text{The total volume of particles}}{\text{The total number of particles}}\right)$$

$$\phi = \left(\frac{6}{\pi} \times \frac{\text{The total volume of particles}}{\text{The total number of particles}}\right)^{\frac{1}{3}}$$

Pigments which can be used in the present invention preferably have an oil absorption of at least 30 ml/100 g, more preferably at least 50 ml/100 g, and most preferably at least 80 ml/100 g, according to JIS K-5101. The amount of the pigment to be added ranges from 0.1 to 10 parts, preferably from 0.2 to 3 parts, and more preferably from 0.3 to 1 part, by weight per part by weight of the microcapsules (wall+interior).

Examples of useful pigments include inorganic pigments, such as calcium carbonate, aluminum hydroxide, barium carbonate, barium sulfate, talc, agalmatolite, kaolin, calcined kaolin, calcium silicate, aluminum silicate, zinc oxide, diatomaceous earth, non-crystalline silica, lithopone, titanium oxide, etc.; and matting agents composed of organic polymer particles or hollow particles, such as polymethyl methacrylate, polyvinylidene chloride, polyvinyl chloride, nylon, polyester, polystyrene, an ureaformalin resin, polyethylene, etc. Of these, inorganic pigments are preferred, with calcium carbonate and calcined kaolin being particularly preferred. The pigment employed is selected therefrom so as to have an average particle size greater than that of the microcapsules.

The oil absorption of these pigments varies depending on the method or degree of treatment, e.g., a production method of pigments, a method or degree of a particular surface treatment, but selection of pigments having an oil absorption falling within the above-recited range brings about a reduction of fog and improved color density.

Other materials to be used in the heat-sensitive recording materials according to the present invention will be described below.

The microcapsules that can be used in the present invention are not of the type where the wall is destroyed by heat or pressure so that the reactant contained in the microcapsules as a core material and the reactant outside of the microcapsules are brought into contact to cause a color formation reaction as in the case of conventional recording materials, rather are of the type in which the reactant present inside or outside of the microcapsules is made permeable through the wall by heating to cause a color formation reaction.

It has been confirmed that both heat developability and preservability of the color former can be ensured by dissolving it in an organic solvent in a broad sense. In order to obtain more sufficient heat developability, the wall of microcapsules is required to have a glass transition temperature of from 60° to 200° C., more preferably from 70° to 150° C. The microcapsule wall changes from a glass state into a rubbery state upon instantaneous heating with a thermal head to thereby cause diffusion and contact of the color forming components through the wall, followed by the color formation reaction. According to microscopic observation, the reactant outside of the capsules predominantly permeates through the wall into the capsules to cause coloration within the inside of the capsules.

The term "glass transition temperature" as herein used means that of the microcapsule wall per se or that of "the system" inclusive of influences exerted from various substances present outside of the capsules. In particular, when a glass transition temperature-controlling agent present outside the capsules is heated melted upon heat recording to intimately contact with the capsule wall, the glass transition temperature greatly decreases.

The glass transition temperature inherent to the capsule wall per se may be controlled by altering the capsule wall-forming materials. Particularly preferred microcapsules include polyurea or polyurethane capsules, polyurea/urethane mixed capsules, ureaformalin capsules, mixed capsules made of polyurea or polyurethane with other synthetic resins in which the synthetic resin is incorporated as a core material, polyester capsules, polyamide capsules, and the like.

The microcapsules used in the heat-sensitive recording materials of this invention can be prepared by various conventional methods such as emulsifying core materials and forming walls of a high polymer around the oil droplets. The reactants that form the high polymer are added to the inside and/or outside of the oil droplets. Examples of the high polymer are polyurethanes, polyureas, polyamides, polyesters, polycarbonates, ureaformaldehyde resins, melamine resins, polystyrenes, styrene-methacrylate copolymers, styrene-acrylate copolymers, and the like.

In the present invention, it is most effective to adopt an encapsulation process comprising polymerization of reactants supplied from the inside of the oil droplets. In other words, this process can provide excellent microcapsules suitable for recording materials which have a uniform particle size and a long storage life.

Details for the above-described encapsulation process and specific examples of compounds used therein are described in U.S. Pat. Nos. 3,726,804 and 3,796,669.

Taking the case of using polyurea or polyurethane as a capsule wall material, for instance, a polyisocyanate and a second component capable of reacting therewith to form a capsule wall, e.g., polyols and polyamines, are mixed in an aqueous phase or an oily liquid to be encapsulated, and the mixture is emulsified or dispersed in water. Elevation of the temperature causes polymerization at the interface of the oil droplets to form microcapsules. In this case, an auxiliary solvent having a low boiling point and a strong dissolving power may be added to the oily liquid to be encapsulated. Polyurea may be formed without the aforesaid second component.

Examples of polyisocyanates and polyols or polyamines reactive therewith which can be used in the abovedescribed encapsulation are disclosed in U.S. Pat. Nos. 3,281,383, 3,773,695 and 3,793,268, Japanese Patent Publication Nos. 40347/73 and 24159/74 and Japanese Patent Application (OPI) Nos. 80191/73 and 84086/73.

For the purpose of accelerating the urethanation, a tin salt, etc. may further be used.

The average particle size of the microcapsules is preferably from 0.4 to 6 μm, more preferably from 0.6 to 3 μm, and most preferably from 0.8 to 2 μm.

It is possible to greatly vary the glass transition temperature of the capsule wall by appropriately selecting the first wall-forming component, e.g., polyisocyanates, and the second wall-forming component, e.g., polyols or polyamines.

In the particular cases of using polyurea or polyurethane capsules, the glass transition temperature of "the system" can be varied by adding a glass transition temperature-controlling agent, e.g., urea compounds, fatty acid amides, hydroxy compounds, carbamic esters, aromatic methoxy compounds, etc., in a solid-dispersed state. Such a controlling agent is added in an amount ranging from 0.1 to 10 parts by weight per part by weight of the microcapsules (wall+interior).

In the encapsulation, a water-soluble high polymer may be used as a protective colloid. The water-soluble high polymer includes water-soluble anionic high polymers, nonionic high polymers and amphoteric high polymers. The anionic high polymers may be either natural or synthetic and include those having a carboxyl group ($-COO^-$) or a sulfo group ($-SO_3^-$). Specific examples of the anionic high polymers are naturally-occurring high polymers, such as gum arabic, alginic acid, etc.; semi-synthetic products, such as carboxymethyl cellulose, phthalated gelatin, sulfated starch, sulfate cellulose, lignin sulfonic acid, etc.; and synthetic products, such as maleic anhydride (inclusive of a hydrolysate thereof) copolymers, (meth)acrylic polymers and copolymers, vinylbenzenesulfonic acid polymers and copolymers, carboxyl-modified polyvinyl alcohol, etc.

Examples of the nonionic high polymers include polyvinyl alcohol, hydroxyethyl cellulose, methyl cellulose, and the like.

Examples of the amphoteric high polymers include gelatin, and the like.

These water-soluble high polymers are used as aqueous solution in concentrations of from 0.01 to 10% by weight.

The color formers that can be used in the present invention include conventional color formers such as substantially colorless basic leuco dyes and diazo compounds.

The basic leuco dyes are capable of donating electrons or accepting protons of acids, etc., to develop a color and are not particularly restricted. Usually, compounds having a partial skeleton of lactones, lactams, sultones, spiropyrans, esters, amides, etc., which are opened or cleaved upon contact with a color developer are employed. Specific examples of such compounds are Crystal Violet Lactone, Benzoyl Leucomethylene Blue, Malachite Green Lactone, Rhodamine B Lactam, 1,3,3-trimethyl-6'-ethyl-8'-butoxyindolinobenzspiropyran, 2-dimethylamino-7-methoxyfluoran, 3-diethylamino-7-methoxyfluoran, 2-methyl-3-anilino-7-cyclohexyl-N-methylaminofluoran, 2-chloro-3-anilino-7-diethylaminofluoran, etc.

Color developers that are reactive to these basic leuco dyes includes phenolic compounds, organic acids or metal salts thereof, hydroxybenzoic esters, and the like. In particular, sparingly water-soluble phenolic compounds and organic acids having a melting point of from 50° to 250° C., and more preferably of from 60° to 200° C., are desirable.

Examples of the phenolic compounds include 4,4'-isopropylidene-diphenol (bisphenol A), p-t-butylphenol, 2,4-di-nitrophenol, 3,4-dichlorophenol, 4,4'-methylenebis(2,6-di-t-butylphenol), p-phenylphenol, 4,4-cyclohexylidenediphenol, 2,2'-methylenebis(4-t-butylphenol), 2,2'-methylenebis(α-phenyl-p-cresol)thiodiphenol, 4,4'-thiobis(6-t-butyl-m-cresol), sulfonyldiphenol, 1,1-bis(4-hydroxyphenyl)-n-dodecane, ethyl 4,4-bis(4-hydroxyphenyl)-1-pentanoate, a p-t-butylphenol-formalin condensate, a p-phenylphenol-formalin condensate, and the like.

Examples of the organic acids and their metal salts include 3-t-butylsalicylic acid, 3,5-t-butylsalicylic acid, 5-α-methylbenzylsalicylic acid, 3,5-di-α-methylbenzylsalicylic acid, 3-t-octylsalicylic acid, 5-α,γ-dimethyl-α-phenyl-γ-phenylpropylsalicylic acid, etc., and zinc salts, lead salts, aluminum salts, magnesium salts, and nickel salts of these acids.

Examples of the hydroxybenzoic esters are ethyl p-hydroxybenzoate, butyl p-hydroxybenzoate, heptyl p-hydroxybenzoate, benzyl p-hydroxybenzoate, and the like.

These compounds are dispersed in a water-soluble high polymer as a protective colloid by means of a sand mill, etc., to obtain a solid dispersion.

The basic leuco dye as a color former is used in an amount of from 0.05 to 1.5 g/m$^2$, and preferably from 0.05 to 0.4 g/m$^2$.

The color developer is used in an amount of from 0.5 to 8 g/m$^2$, and preferably from 0.5 to 4 g/m$^2$.

The diazo compounds that can be used as color formers in the present invention include diazonium salts represented by the formula $ArN_2{+}X^-$, wherein Ar represents a substituted or unsubstituted aromatic moiety; $N_2{+}$ represents a diazonium group; and $X^-$ represents an acid anion, which are capable of reacting with a coupling component to develop a color and are also decomposable upon irradiation of light.

Examples of the diazonium that form salts include 4-diazo-1-dimethylaminobenzene, 4-diazo-1-diethylaminobenzene, 4-diazo-1-benzoylamino-2,5-diethoxybenzene, 4-diazo-1-morpholinobenzene, 4-diazo-1,4-methoxybenzoylamino-2,5-diethoxybenzene, and the like.

Examples of the acid anion include $C_nF_{2n+1}COO^-$ (n is an integer of from 3 to 9), $C_mF_{2m+1}SO_3^-$ (m is an integer of from 2 to 8), $(ClF_{2l+1}SO_2)_2CH^-$ (l is an integer of from 1 to 18),

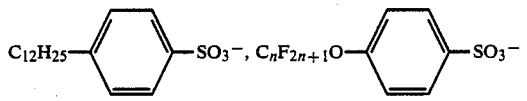

(n is an integer of from 3 to 9), $BF_4^-$, $PF_6^-$, etc.

Specific examples of the diazo compounds (diazonium salts) are shown below.

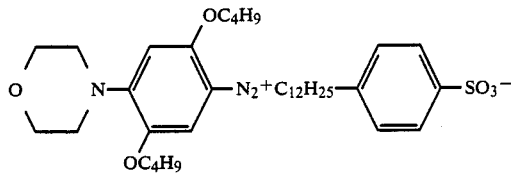

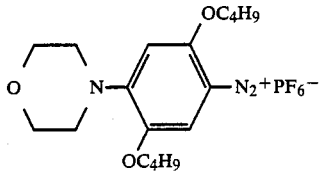

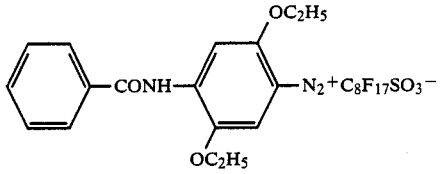

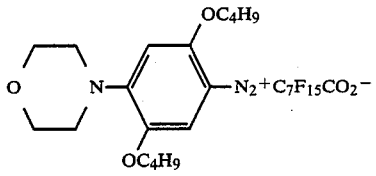

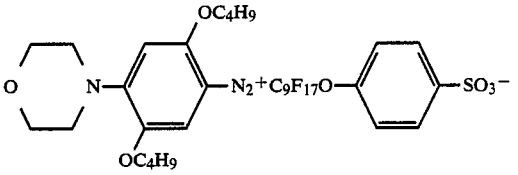

Color developers reactive with these diazonium salts are coupling agents capable of coupling with the diazonium salt in a basic atmosphere to form color. Specific examples of the coupling agents are resorcin, phloroglucinol, sodium 2,3-dihydroxynaphthalene-6-sulfonate, 1-hydroxy-2-naphthoic acid morpholinopropylamide, 2-hydroxy-3-naphthoic acid N-dodecyloxypropylamide, 2-hydroxy-3-naphthoic acid tetradecylamide, acetanilide, acetoacetanilide, benzoylacetanilide, 1-(2',4',6'-trichlorophenyl)-3-anilino-5-pyrazolone, 1-phenyl-3-phenylacetamido-5-pyrazolone, and the like. These coupling agents may be used in combination of two or more thereof to obtain a color image of a desired tone.

In the system where a diazonium salt is employed as a color former, a basic substance may be used in combination therewith for the purpose of accelerating color development.

The basic substances used include a sparingly water-soluble or water-insoluble basic substance and a substance that generates an alkali by heating. Examples of these basic substances include inorganic and organic ammonium salts, organic amines, amides, urea or thiourea and derivatives thereof, nitrogen-containing compounds, such as thiazoles, pyrroles, pyrimidines, piperazines, guanidines, indoles, imidazoles, imidazolines, triazoles, morpholines, piperidines, amidines, formazines, pyridines, etc., and the like. Specific examples of these compounds are ammonium acetate, tricyclohexylamine, octadecylbenzylamine, allylurea, thiourea, methylthiourea, 2-bnezylimidazole, 2-phenyl-4-methyl-imidazole, 2-undecyl-imidazoline, 1,2-phenyl-2-imidazole, 1,2,3-triphenylguanidine, 1,2-ditolylguanidine, 1,2-dicyclohexylguanidine, guanidinetrichloroacetate, N,N'-dibenzylpiperazine, 4,4'-dithiomorpholine, 2-aminobenzothiazole, etc. These basic substances may also be used as combinations of two or more thereof.

It is preferred that the above-described coupling agent and the basic substance, if used, are added in the form of fine dispersion preferably having an average particle size of 0.1 to 5 μm.

The amounts of the coupling agent and the basic substance added are preferably from 0.1 to 10 parts by weight and preferably from 0.1 to 20 parts by weight, respectively, per part by weight of the diazo compound. Further, the diazo compound is preferably coated to a dry coverage of from 0.05 to 2.0 g/m$^2$.

The basic leuco dye or diazonium salt to be used as a color former is encapsulated as being dissolved in an organic solvent.

The organic solvent used in the present invention preferably has a boiling point of not lower than 180° C. since those having too a low boiling point are lost due to vaporization during storage, e.g., phosphoric esters, phthalic esters, other carboxylic acid esters, fatty acid amides, alkylated biphenyls, alkylated terphenyls, chlorinated paraffins, alkylated naphthalenes, diarylethanes, and the like. Specific examples of these organic solvents are tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, chlorinated paraffin, diisopropylnaphthalene, 1,1'-ditolylethane, 2,4-di-t-amylphenol, N,N-dibutyl-2-butoxy-5-t-octylaniline, etc.

A heat-sensitive coating composition comprising the above-mentioned components is coated on a support using an appropriate conventional binder. The binder used includes various emulsions of polyvinyl alcohol, methyl cellulose, carboxymethyl cellulose, hydroxypropyl cellulose, gum arabic, gelatin, polyvinyl pyrrolidone, casein, a styrenebutadiene latex, an acrylonitrile-butadiene latex, polyvinyl acetate, polyacrylates, an ethylene-vinyl acetate copolymer, etc. The amount of the binder used ranges from 0.5 to 5 g/m$^2$.

Each of the microcapsules containing a color former and another component is solid-dispersed or dissolved in water, and both dispersions or solutions are mixed to prepare a coating composition. The coating composition is coated on a conventional support, such as paper and synthetic resin films, according to a known manner, such as bar coating, blade coating, air knife coating, gravure coating, roll coating, spray coating, dip coating, etc., and dried to form a heat-sensitive recording layer having a solid content of from 2.5 to 25 g/m$^2$.

It is advantageous from the viewpoint of the shelf life with the passage of time to use a neutral paper having a heat extraction pH of 6 to 9, which is sized by a neutral sizing agent such as alkylketene dimer, etc. (e.g., Japanese Patent Application (OPI) No. 14281/80 (corresponding to U.S. Pat. No. 4,255,491)) as the paper for the support.

Also, for preventing the permeation of the coating liquid into a paper support and improving the contact with the heat-sensitive recording layer with a thermal recording head, a paper having the ratio $$\frac{\text{stocking sizing degree}}{(\text{basis weight per meter})^2} \geqq 3 \times 10^{-3}$$

and a Beck smoothness of higher than 90 seconds, as described in Japanese Patent Application (OPI) No. 116687/82 (corresponding to U.S. Pat. No. 4,416,939) is advantageous.

Furthermore, a paper having the optical surface roughness of 8 microns or less and a thickness of from 40 to 75 microns described in Japanese Patent Application (OPI) No. 136492/83; a paper having a density of 0.9 g/cm$^3$ or less and an optical contact percentage of 15% or more as described in Japanese Patent Application (OPI) No. 69091/83; a paper manufactured from a pulp having a Canadian standard freeness (JIS P8121) of 400 cc or more for preventing the permeation of a coating liquid in the paper as described in Japanese Patent Application (OPI) No. 69097/83; a paper manufactured by Yankee paper machine the lustrous surface thereof is used as the coating surface for improving the coloring density and the resolving power as described in Japanese Patent Application (OPI) No. 65695/83 (corresponding to U.S. Pat. No. 4,466,007); and a paper subjected to a corona discharging treatment for improving the coating aptitude as described in Japanese Patent Application (OPI) No. 35985/84 can be used in this invention with good results.

Still further, various supports which are used in the field of ordinary heat-sensitive recording papers can be also used as the supports for the heat-sensitive recording materials of this invention.

The heat-sensitive recording materials in accordance with the present invention are excellent in storability, free from head stain and also excellent in color developability upon heating.

When the heat-sensitive recording materials of the present invention are applied to systems using diazonium salts as color formers, the heat-recorded image may be fixed by overall exposure to ultraviolet rays in a conventional manner by which any unreacted diazonium salt is decomposed.

The present invention will now be illustrated in greater detail with reference to the following examples and comparative examples, but it should be understood that the present invention is not limited thereto. In these examples, all the parts, percents and ratios are by weight unless otherwise indicated.

EXAMPLE 1

Preparation of Microcapsules

Two parts of a diazonium compound of the formula:

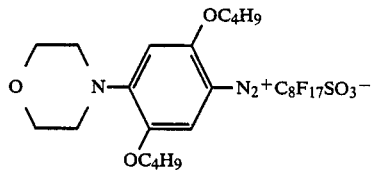

6 parts of a 3:1 adduct of tolylene diisocyanate and trimethylolpropane and 18 parts of 3:1 adduct of xylylene diisocyanate and trimethylolpropane were dissolved in a mixed solvent of 24 parts of dibutyl phthalate and 5 parts of ethyl acetate. The solution was emulsified in an aqueous solution of 3.5 parts of polyvinyl alcohol and 1.7 part of gelatin in 58 parts of water at 20° C. To the resulting emulsion was added 100 parts of water, and the mixture was warmed to 60° C. while stirring. After two hours at 60° C., a microcapsule slurry containing the diazonium compound as a core material and having an average particle size of about 2 μm was obtained.

Preparation of Coupling Agent Dispersion

Twenty parts of 2-hydroxy-3-naphthoic acid anilide were dispersed in 100 parts of a 5% aqueous solution of polyvinyl alcohol in a sand mill for about 24 hours to prepare a dispersion of a coupling agent having an average particle size of 3 μm.

Preparation of Other Dispersions

Twenty parts of triphenylguanidine were dispersed in 100 parts of a 5% aqueous solution of polyvinyl alcohol in a sand mill for about 24 hours to prepare a dispersion of a basic substance having an average particle size of 3 μm.

Twenty parts of p-benzyloxyphenol were dispersed in 100 parts of a 5% aqueous solution of polyvinyl alcohol in a sand mill for about 24 hours to prepare a dispersion of p-benzyloxyphenol having an average particle size of 3 μm.

Preparation of Heat-Sensitive Recording Material

A mixture consisting of 50 parts of the microcapsule solution, 15 parts of the coupling agent dispersion, 15 parts of the triphenylguanidine dispersion and 30 parts of the p-benzyloxyphenol dispersion was further mixed with 15 parts of a 40% dispersion of calcium carbonate having an average particle size of about 3.3 μm and an oil absorption of 85 ml/100 g as a pigment to prepare a coating composition.

The coating composition was coated on fine paper having a basis weight of 50 g/m$^2$ with a coating rod to a dry coverage of 10 g/m$^2$, followed by drying at 45° C. for 30 minutes to produce a heat-sensitive recording material. The glass transition temperature of "the intersystem" inclusive of the influence from the mutual action of the capsule walls and p-benzyloxyphenol was 130° C. to 140° C.

COMPARATIVE EXAMPLE 1

A heat-sensitive recording material was produced in the same manner as described in Example 1 but using no pigment.

COMPARATIVE EXAMPLE 2

A heat-sensitive recording material was produced in the same manner as described in Example 1 but using amorphous silica having an average particle size of 0.7 μm and an oil absorption of 290 ml/100 g in place of calcium carbonate.

COMPARATIVE EXAMPLE 3

A heat-sensitive recording material was produced in the same manner as described in Example 1 but using calcium carbonate having an average particle size of about 1.5 μm in place of calcium carbonate having an average particle size of about 3.3 μm.

Each of the heat-sensitive recording materials obtained in Example 1 and Comparative Examples 1 to 3 was tested for abrasion fog and running properties in accordance with the following test methods.

(1) Abrasion Fog

Resistance to abrasion fog is designated as O if the sample slightly develops color when the coated surface of the material placed on a glass plate is scratched with a nail but does not substantially develop color when on a paperboard.

Resistance to abrasion fog is designated as Δ if the sample slightly develops color upon scratching with a nail on a paperboard.

Resistance to abrasion fog is designated as X if the sample substantially develops color upon scratching with a nail on a paperboard.

(2) Running Property

The heat-sensitive recording material was run on a heat-sensitive facsimile (UF-920, manufactured by Matsushita Denso K.K.), and the image quality, the running noise and adhesion to the head were evaluated according to the following scale:

O: good (no problem on practical use)

Δ: slightly poor

X: problems involved on practical use

The results of these tests are shown in Table 1 below.

TABLE 1

| | Abrasion Fog | Running Noise | Adhesion to Head |
|---|---|---|---|
| Example 1 | O | O | O |
| Comparative Example 1 | X | X | X |
| Comparative Example 2 | X | Δ | Δ |
| Comparative Example 3 | Δ | Δ | Δ |

As can be seen from Table 1 above, the heat-sensitive recording material according to the present invention, where a pigment having an average particle size greater than that of microcapsules is used, is excellent in freedom from abrasion fog, running noise and adhesion to a thermal head, while the material of Comparative Example 1 where no pigment is used and the materials of Comparative Examples 2 and 3 where the particle size of the pigment is smaller than that of the microcapsules are inferior in these respects.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive recording layer containing microcapsules containing a color former and an organic solvent as core materials and a color developer exterior thereto, the wall of said microcapsules being impermeable to both of the color former and the color developer at room temperature but becoming permeable to at least one of the color former and color developer upon the application of heat, wherein said heat sensitive recording layer further contains a pigment having an average particle size 1.3 or more times greater than that of the microcapsules, and said pigment has an oil absorption of at least 30 ml/100 g.

2. A heat-sensitive recording material as in claim 1, wherein the pigment has an oil absorption of at least 50 ml/100 g.

3. A heat-sensitive recording material as in claim 2, wherein the pigment has an oil absorption of at least 80 ml/100 g.

4. A heat-sensitive recording material as in claim 1, wherein the pigment is present in an amount of from 0.1 to 10 parts by weight per part by weight of the microcapsules.

5. A heat-sensitive recording material as in claim 4, wherein the pigment is present in an amount of from 0.2 to 3 parts by weight per part by weight of the microcapsules.

6. A heat-sensitive recording material as in claim 5, wherein the pigment is present in an amount of from 0.3 to 1 parts by weight per part by weight of the microcapsules.

7. A heat-sensitive recording material as in claim 1, wherein the pigment is an inorganic pigment selected from the group consisting of calcium carbonate, aluminum hydroxide, barium carbonate, barium sulfate, talc, agalmatolite, kaolin, calcined kaolin, calcium silicate, aluminum silicate, zinc oxide, diatomaceous earth, noncrystalline silica, lithopone, and titanium oxide.

8. A heat-sensitive recording material as in claim 1, wherein said pigment is a matting agent composed of organic polymer particles or hollow particles.

9. A heat-sensitive recording material as in claim 8, wherein said matting agent is selected from the group consisting of polymethyl methacrylate, polyvinylidene, polyvinyl chloride, nylon, polyester, polystyrene, urea-formalin resin, and polyethylene.

10. A heat-sensitive recording material as in claim 1, wherein the average particle size of the microcapsules is from about 0.4 to about 6 μm.

11. A heat-sensitive recording material as in claim 10, wherein the average particle size of the microcapsules is from 0.6 to 3 μm.

12. A heat-sensitive recording material as in claim 11, wherein the average particle size of the microcapsules is from 0.8 to 2 μm.

* * * * *